US005423443A

United States Patent [19]

Keller

[11] Patent Number: 5,423,443

[45] Date of Patent: Jun. 13, 1995

[54] INSERTABLE AND REMOVABLE STOPPER DEVICE FOR A CARTRIDGE

[76] Inventor: Wilhelm A. Keller, Obstgartenweg 9, CH-6402 Merlischachen, Switzerland

[21] Appl. No.: 91,205

[22] Filed: Jul. 14, 1993

[30] Foreign Application Priority Data

Jul. 17, 1992 [CH] Switzerland ..... 92810547.7

[51] Int. Cl.[6] ..... B65D 39/00; B65D 55/02

[52] U.S. Cl. ..... 215/296; 215/211; 215/214; 215/215; 215/276; 215/303; 215/364

[58] Field of Search ..... 215/207, 211, 213, 214, 215/215, 276, 296, 302, 303, 355, 364

[56] References Cited

U.S. PATENT DOCUMENTS

| | | | |
|---|---|---|---|
| 3,386,273 | 6/1968 | Green | 215/207 X |
| 3,409,159 | 11/1968 | Velt | 215/213 |
| 3,753,510 | 8/1973 | Hedgewick et al. | 215/213 X |
| 3,811,590 | 5/1974 | Hall, Jr. | 215/207 |
| 3,820,675 | 6/1974 | Malles | 215/214 X |
| 3,841,513 | 10/1974 | O'Connor et al. | 215/214 X |
| 4,098,417 | 7/1978 | Bennett | 215/204 |
| 4,353,472 | 10/1982 | Burton et al. | 215/211 |
| 4,391,382 | 7/1983 | Emich | 215/213 |
| 4,496,065 | 1/1985 | Nagy | 215/207 |
| 4,526,281 | 7/1985 | Herr | 215/211 |
| 5,137,182 | 8/1992 | Keller . | |

FOREIGN PATENT DOCUMENTS

| | | |
|---|---|---|
| 0408331 | 1/1991 | European Pat. Off. . |
| 2619321 | 2/1989 | France . |

*Primary Examiner*—Gary E. Elkins
*Assistant Examiner*—Vanessa Caretto
*Attorney, Agent, or Firm*—Marks & Murase

[57] ABSTRACT

A closure stopper for a dispensing cartridge is withdrawn from the dispensing opening by a screw ring. An extension piece of the stopper projects over the screw ring. A disk or similar component is detachably connected to the extension piece and to the screw ring to pull the stopper when the screw ring is moved away from the dispensing cartridge.

13 Claims, 3 Drawing Sheets

INSERTABLE AND REMOVABLE STOPPER DEVICE FOR A CARTRIDGE

BACKGROUND OF THE INVENTION

The present invention refers to a stopper for dispensing cartridges.

Dispensing cartridges are used for the localized and proportioned application of adhesives, sealing masses and other highly viscous substances in many areas. Industry, construction, and dental technique may be cited as examples. Apart from single-chamber cartridges, there are also multiple-chamber, mostly two-chamber cartridges for two-component substances. The chambers of said cartridges, and also the single-chamber cartridges, of course, must be tightly sealed until their use. Insertable stoppers are commonly used for this purpose, which are manufactured separately from the cartridges, inserted into the dispensing opening of the cartridge, and secured by means of a screw cap.

Since the sealing action of said stopper is only caused by the compression of the stopper in the dispensing opening, relatively great forces are required in order to remove it. Up to now, tools have been usual for this purpose, or else the stopper must comprise a correspondingly strong extension providing a good grip.

The first possibility is problematic in that said special tool is not always at hand, and in that a particular tool is required for each cartridge type. The second possibility makes the stopper more expensive and also increases the required space for storing the cartridge as said extension must be quite strong and large in order to provide a good manual grip.

SUMMARY OF THE INVENTION

It is an object of the present invention to provide a stopper which can be withdrawn from a dispensing cartridge without any tools.

This object is attained by a single or multiple stopper of a dispensing cartridge wherein said stopper comprises an extension which projects over a securing means which is attachable to said dispensing cartridge, and wherein a removing means is attachable to said extension in such a manner that it rests at least partially on a bearing surface of said securing means.

Accordingly, said stopper is inserted in the dispensing opening of the cartridge and, if necessary, pressed in and locked by means of a screw ring or the like. The stopper comprises an extension which projects over said screw ring. A removing means is now placed laterally over the end of said screw ring in such a manner as to engage with said extension. Said removing means is designed to allow rotating said screw ring with respect to said stopper since it must be screwed off in order to replace said stopper with the dispensing nozzle. During this operation, however, a traction force is applied to said stopper due to said removing means, and it is thus withdrawn.

BRIEF DESCRIPTION OF THE DRAWINGS

The invention is further explained hereinafter with reference to an embodiment which is illustrated in the figures.

DETAILED DESCRIPTION OF THE INVENTION

Figure 1:
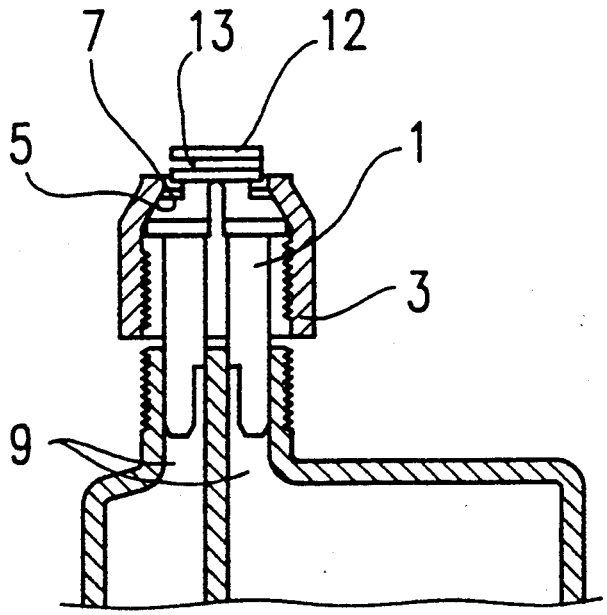
FIG. 1 shows a cross-section of an insertable stopper with a screw ring.
Figure 2:
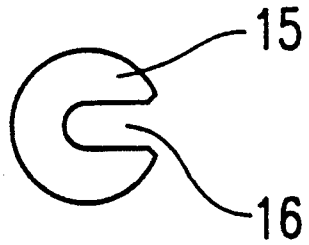
FIG. 2 shows a plan view of a removing means.

FIG. 1 shows insertable stopper 1 with screw ring 3 surrounding it. Screw ring 3 has an inner tapered portion 5 which bears on shoulder 7 of insertable stopper 1 and which is capable of pressing it into the dispensing opening of the cartridge. In the present case, the extension of inserting stopper 1 has the configuration of a traction plate 12 which projects over screw ring 3 and is connected to the body of inserting stopper 1 by a neck 13.

Figure 3:
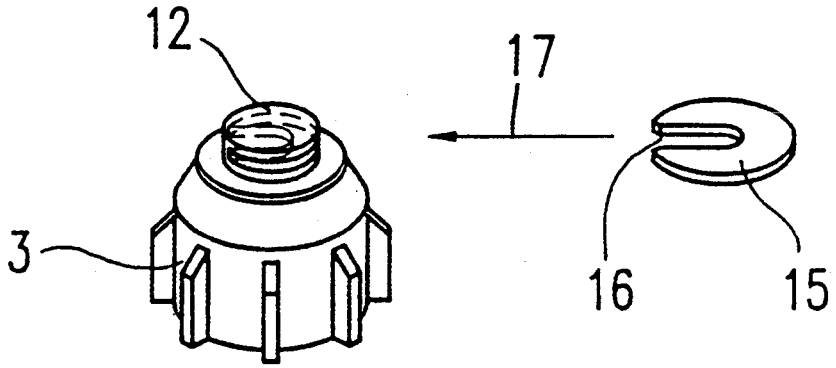
FIG. 3 shows the attachment of said removing means.
Figure 4:
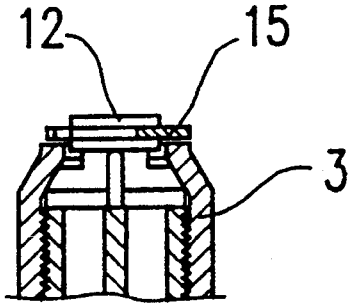
FIG. 4 shows a partial cross-section of the closed dispensing opening of a dispensing cartridge secured by the screw ring embodiment.

Removing means 15 has the configuration of a slit disk. Slot 16 is adapted to receive neck 13, and disk 15 is somewhat thinner than the length of neck 13. As shown in FIG. 3, disk 15 can be slid over the upper rim of screw ring 3 according to arrow 17 and under traction plate 12, thus resulting in the condition of FIG. 4.

If the closed cartridge is to be opened, it is sufficient to screw off screw ring 3, whereby stopper 1 is simultaneously withdrawn. It is important in this context that disk 15 can slide on the upper edge of screw ring 3 and/or rotate with respect to insertable stopper 1 even under the pressure forces resulting when it is withdrawn.

Figure 5:
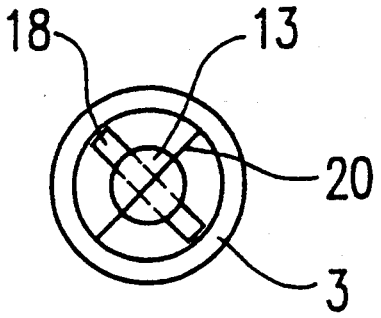
FIG. 5 shows a plan view from above of an embodiment of the removing means comprising a crossbar.

Modifications are conceivable within the scope of the invention. Instead of a disk, a generally U-shaped removing means may be used, its shanks receiving the extension of the stopper between them. The base of the U as well as the shank ends are preferably made flat so that the screw ring can be turned under them. However, rotatability around the stopper extension may be sufficient. In order to facilitate its attachment to the extension, in particular to neck 13, the shank ends as well as the slot ends of disk 15 may be made in the shape of a funnel. It is also possible to provide the extension with a breach, a bore or the like through which the removing means is stuck in the manner of a bolt, a pin or a linchpin 18 (FIG. 5). The inserted end of the removing means is preferably spread or provided with barb elements in order to prevent it from falling off. It is also possible to insert one shank while a second shank embraces the neck.

Figure 6:
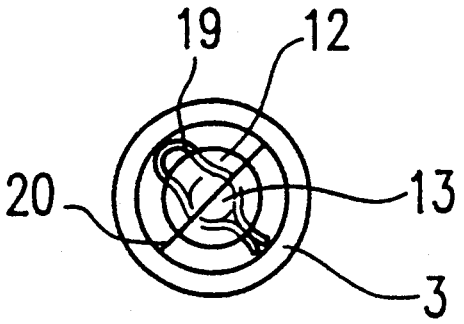
FIG. 6 shows a plan view from above of an embodiment comprising a clamp.
Figure 7:
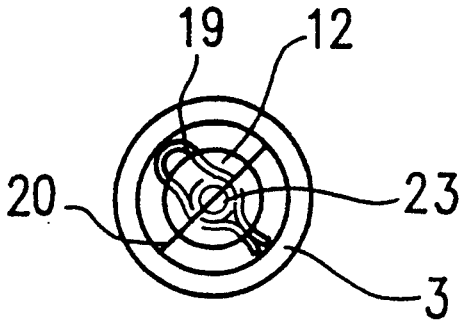
FIG. 7 shows a plan view from above of an embodiment having a tapered extension.

Another possibility consists in providing an oblong removing means of an elastic material in the form of a clamp 19, as shown in FIG. 6 by way of example. If it is generally U-shaped, it may be laterally slid over neck 13, the shanks embracing the neck of the extension. The shanks are preferably provided with a widened portion which is adapted to the neck, whereby the removing means will snap in with neck 13 of the extension. It is also possible to use a shape which is closed on both sides, approximately corresponding to an elongated oval, and to provide the extension preferably with a tapering end. FIG. 7 shows such an extension from above where the tapered end 23 has a smaller diameter than the diameter at other portions of the extension. The removing means will then be plugged onto the extension from above, the wedge action of the tapered end spreading the removing means against its spring force, and will snap into the necking. In this case as well a widened portion may be provided in the center of the shanks in order to prevent an undesired lateral displacement.

Figure 8:
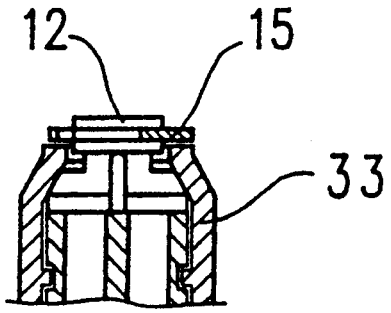
FIG. 8 shows a partial cross-section of the closed dispensing opening of a dispensing cartridge secured by a bayonet lock.

Instead of a screw ring, an element securing the stopper on dispensing opening 9 in another manner may be present, e.g. one with a bayonet lock 33. FIG. 8 shows a bayonet lock 33 utilizing notches to secure the bayonet lock 33 to the dispensing cartridge instead of threads as used in the screw ring 3. Since this element will in any case be designed for manual operation, it may be sufficient to simply pull it out in order to provide the necessary force to withdraw the stopper. In these cases, only a limited rotatability of the removing means with respect to the securing element or the stopper is required if the securing element is unlocked by a turning movement, whereby the above-mentioned solution involving pins etc. becomes applicable, in particular.

The cartridges may also be delivered with the inserted stopper only, i.e. without the screw ring 3. The latter is generally available at the location of application, e.g. if it serves for securing the mixing attachment or the dispensing nozzle to the cartridge.

The indicated round parts, as disk 15 or traction plate 12, in particular, may also have different, e.g. rectangular or polygonal contours. Neck 13 as well may be modified in favor of a web extending across the entire width of traction plate 12. It is also possible to provide neck 13 with securing elements such as recesses or projections which correspond to matching complementary shapes of removing means 15 to keep the removing means 15 from falling off.

It is also conceivable that the cartridge consists of separately manufactured and possibly separately filled individual bodies whose outlet openings with the partial stoppers comprised therein may be combined to give one of the presented embodiments or alternatives. In FIGS. 5 and 6, the partition line 20 indicates a possible division of the stopper into two parts, clamp 19 and bar 18 as well as screw ring 3, respectively, being in one piece in these cases. The two partial stoppers are then withdrawn together.

I claim:

1. A stopper device for a dispensing cartridge having a dispensing opening, comprising at least two stoppers, each stopper having an extension piece;

a securing means having a bearing surface; and a removing means detachably connected to said extension pieces of said stoppers and detachably connected to at least part of said bearing surface of said securing means; and wherein said stoppers and said securing means are detachably connected to said dispensing cartridge.

2. The stopper device of claim 1, wherein said securing means comprises a screw ring which is screwed onto the dispensing opening of said cartridge and has a central opening through which said extensions project.

3. The stopper device of claim 1, wherein said securing means comprises an element enclosing said dispensing opening, said element including a bayonet lock for locking said element to said dispensing cartridge.

4. The stopper device of claim 1, wherein said extension pieces comprise traction plates arranged on a neck, both of which project over said securing means, and wherein said removing means has a U-shaped configuration with shanks for accommodating said neck and for engaging a bottom of said traction plates when said removing means is inserted in between said traction plates and said securing means.

5. The stopper device of claim 4, wherein said removing means comprises a slit disk.

6. The stopper device of claim 1, wherein each extension piece has a bore through which a pin-shaped removing means having a tip and an end is inserted such that said tip and said end rest on said bearing surface of said securing means.

7. The stopper of claim 1, wherein said removing means is provided with first retention elements having at least one of recesses and projections, and wherein each extension piece has second retention elements which have at least one of recesses and projections complementary to those of said first retention elements.

8. The stopper device of claim 1, wherein said stoppers are withdrawn from said dispensing cartridge together by said removing means.

9. The stopper device of claim 1, wherein each of said stoppers is a partial stopper, and said stoppers are attached.

10. A stopper device for a dispensing cartridge, comprising:

at least two stoppers, each stopper having an extension piece;

a securing means having a bearing surface; and a removing means detachably connected to said extension pieces of said stoppers and detachably connected to at least part of said bearing surface of said securing means; and wherein said stoppers and said securing means are detachably connected to said dispensing cartridge, wherein each extension piece has a necking and said removing means comprises an elastic removing means having a spring element with two shanks for embracing said necking.

11. The stopper of claim 10, wherein each extension piece further comprises a tapered end whose smallest thickness is smaller than a distance between said two shanks of said elastic removing means in an unextended condition.

12. The stopper device of claim 10, wherein said elastic removing means comprises at least one of an elongated, U-shaped and a bilaterally closed spring element having two shanks.

13. The stopper device of claim 10, wherein each of said stoppers is a partial stopper, and said stoppers are attached.

* * * * *